US010823529B1

(12) United States Patent
Casado

(10) Patent No.: US 10,823,529 B1
(45) Date of Patent: Nov. 3, 2020

(54) FOREARM BRACE PLUG ASSEMBLY

(71) Applicant: Robert Casado, Frisco, TX (US)

(72) Inventor: Robert Casado, Frisco, TX (US)

( * ) Notice: Subject to any disclaimer, the term of this patent is extended or adjusted under 35 U.S.C. 154(b) by 0 days.

(21) Appl. No.: 16/792,699

(22) Filed: Feb. 17, 2020

(51) Int. Cl.
*F41C 33/00* (2006.01)

(52) U.S. Cl.
CPC ..... *F41C 33/001* (2013.01)

(58) Field of Classification Search
CPC ..... F41C 23/12; F41C 27/22; F41C 33/001
See application file for complete search history.

(56) References Cited

U.S. PATENT DOCUMENTS 454,201 A 6/1891 Bowyer
544,269 A * 8/1895 Winters ..... F41C 23/08 42/74
3,708,801 A * 1/1973 Davis ..... F41C 33/001 2/94
4,243,165 A * 1/1981 Schuler ..... F41C 33/001 2/94
5,575,410 A 11/1996 Compton
5,900,293 A * 5/1999 Zettle ..... B29C 49/04 220/666
5,967,387 A 10/1999 Bakhtiar
6,467,212 B1 * 10/2002 Apel ..... F41C 23/08 42/74
6,976,333 B2 * 12/2005 Sims ..... F41C 23/08 42/74
8,904,692 B2 * 12/2014 Ballard ..... F41C 23/20 42/74
9,664,477 B1 5/2017 Reavis, III
D815,804 S 4/2018 Cirigliano
10,408,522 B2 * 9/2019 Tsui ..... B65D 15/02
2005/0121403 A1 6/2005 Stubbs
2019/0390936 A1 * 12/2019 Keng ..... B25F 1/00

OTHER PUBLICATIONS

"SB Tactical Void Plug", http://sigforum.com/eve/forums/a/tpc/f/630601935/m/3200007164 (Year: 2019).*

* cited by examiner

*Primary Examiner* — Joshua T Semick

(57) ABSTRACT

A forearm brace plug assembly for protecting a forearm brace during storage includes a plug that is insertable into a forearm space in a forearm brace of a firearm. The plug inhibits the forearm brace from being deformed during storage. Moreover, the plug is comprised of a resiliently compressible material to conform to the shape of the forearm space. The plug has a storage chamber therein for storing objects. A door is removably attachable to the plug and the door is positioned over the storage chamber to retain the objects within the storage chamber.

11 Claims, 3 Drawing Sheets

FOREARM BRACE PLUG ASSEMBLY

CROSS-REFERENCE TO RELATED APPLICATIONS

Not Applicable

STATEMENT REGARDING FEDERALLY SPONSORED RESEARCH OR DEVELOPMENT

Not Applicable

THE NAMES OF THE PARTIES TO A JOINT RESEARCH AGREEMENT

Not Applicable

INCORPORATION-BY-REFERENCE OF MATERIAL SUBMITTED ON A COMPACT DISC OR AS A TEXT FILE VIA THE OFFICE ELECTRONIC FILING SYSTEM

Not Applicable

STATEMENT REGARDING PRIOR DISCLOSURES BY THE INVENTOR OR JOINT INVENTOR

Not Applicable

BACKGROUND OF THE INVENTION

(1) Field of the Invention

The disclosure relates to plug devices and more particularly pertains to a new plug device for protecting a forearm brace during storage.

(2) Description of Related Art Including Information Disclosed Under 37 CFR 1.97 and 1.98

The prior art relates to plug devices. The prior art discloses a cylinder that is positionable in a cuff of a shirt sleeve for inhibiting the cuff from being deformed. The prior art discloses a ring that is positionable around a collar of a shirt for inhibiting the collar from being deformed. Additionally, the prior art discloses a deformable panel that can be wrapped into a cylindrical shape for positioning in a cuff of a shirt sleeve to inhibit the cuff from being deformed. The prior art discloses a forearm brace for a firearm that includes a hinged closure.

BRIEF SUMMARY OF THE INVENTION

An embodiment of the disclosure meets the needs presented above by generally comprising a plug that is insertable into a forearm space in a forearm brace of a firearm. The plug inhibits the forearm brace from being deformed during storage. Moreover, the plug is comprised of a resiliently compressible material to conform to the shape of the forearm space. The plug has a storage chamber therein for storing objects. A door is removably attachable to the plug and the door is positioned over the storage chamber to retain the objects within the storage chamber.

There has thus been outlined, rather broadly, the more important features of the disclosure in order that the detailed description thereof that follows may be better understood, and in order that the present contribution to the art may be better appreciated. There are additional features of the disclosure that will be described hereinafter and which will form the subject matter of the claims appended hereto.

The objects of the disclosure, along with the various features of novelty which characterize the disclosure, are pointed out with particularity in the claims annexed to and forming a part of this disclosure.

BRIEF DESCRIPTION OF SEVERAL VIEWS OF THE DRAWING(S)

The disclosure will be better understood and objects other than those set forth above will become apparent when consideration is given to the following detailed description thereof. Such description makes reference to the annexed drawings wherein.

DETAILED DESCRIPTION OF THE INVENTION

Figure 2:
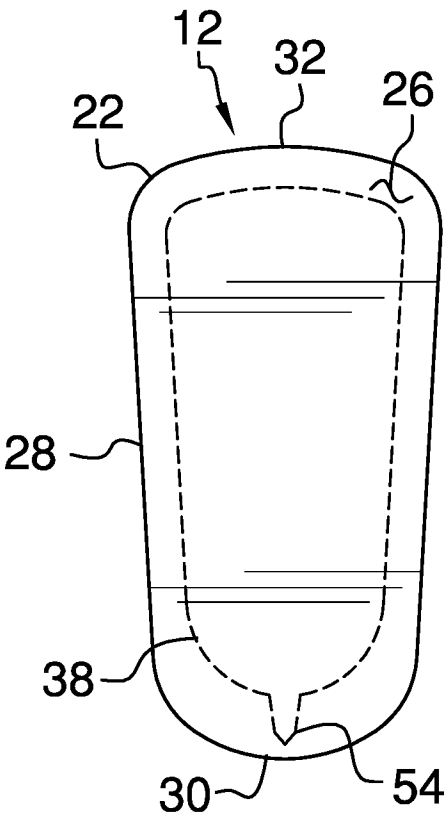
FIG. 2 is a bottom phantom view of an embodiment of the disclosure.
Figure 1:
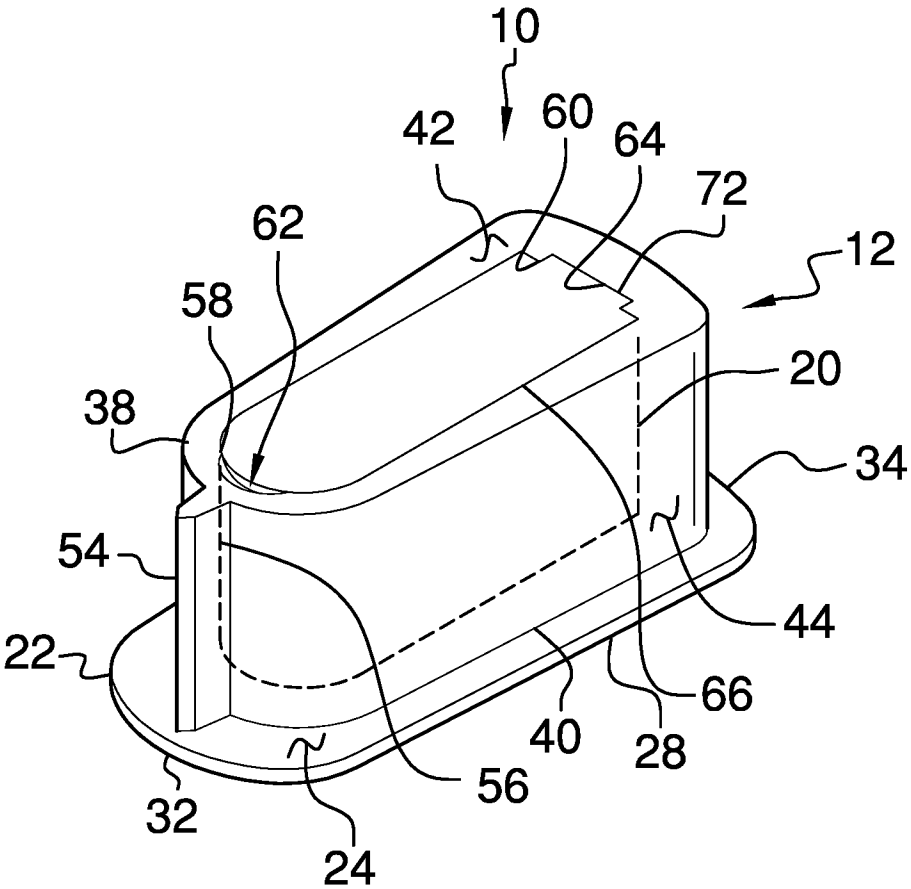
FIG. 1 is a perspective phantom view of a forearm brace plug assembly according to an embodiment of the disclosure.
Figure 4:
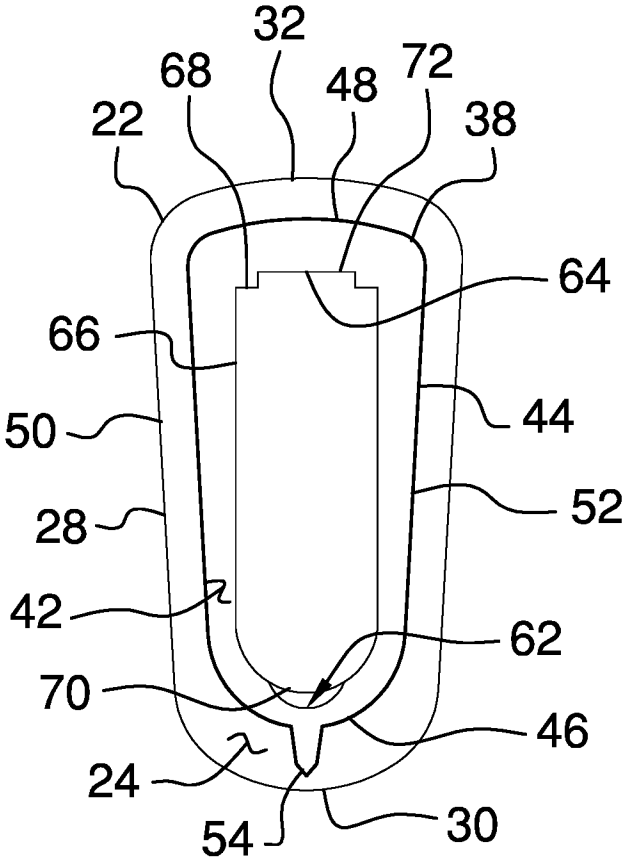
FIG. 4 is a top view of an embodiment of the disclosure.
Figure 3:
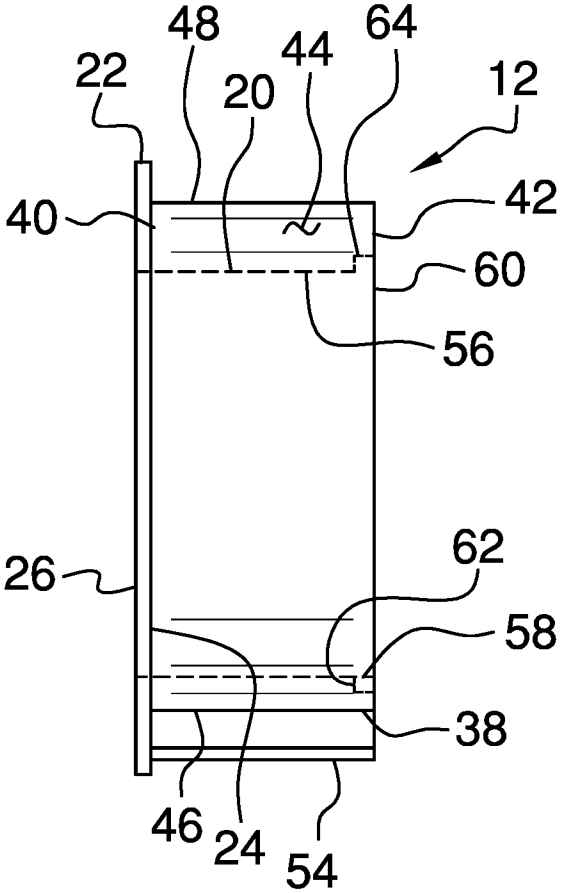
FIG. 3 is a right side phantom view of an embodiment of the disclosure.
Figure 5:
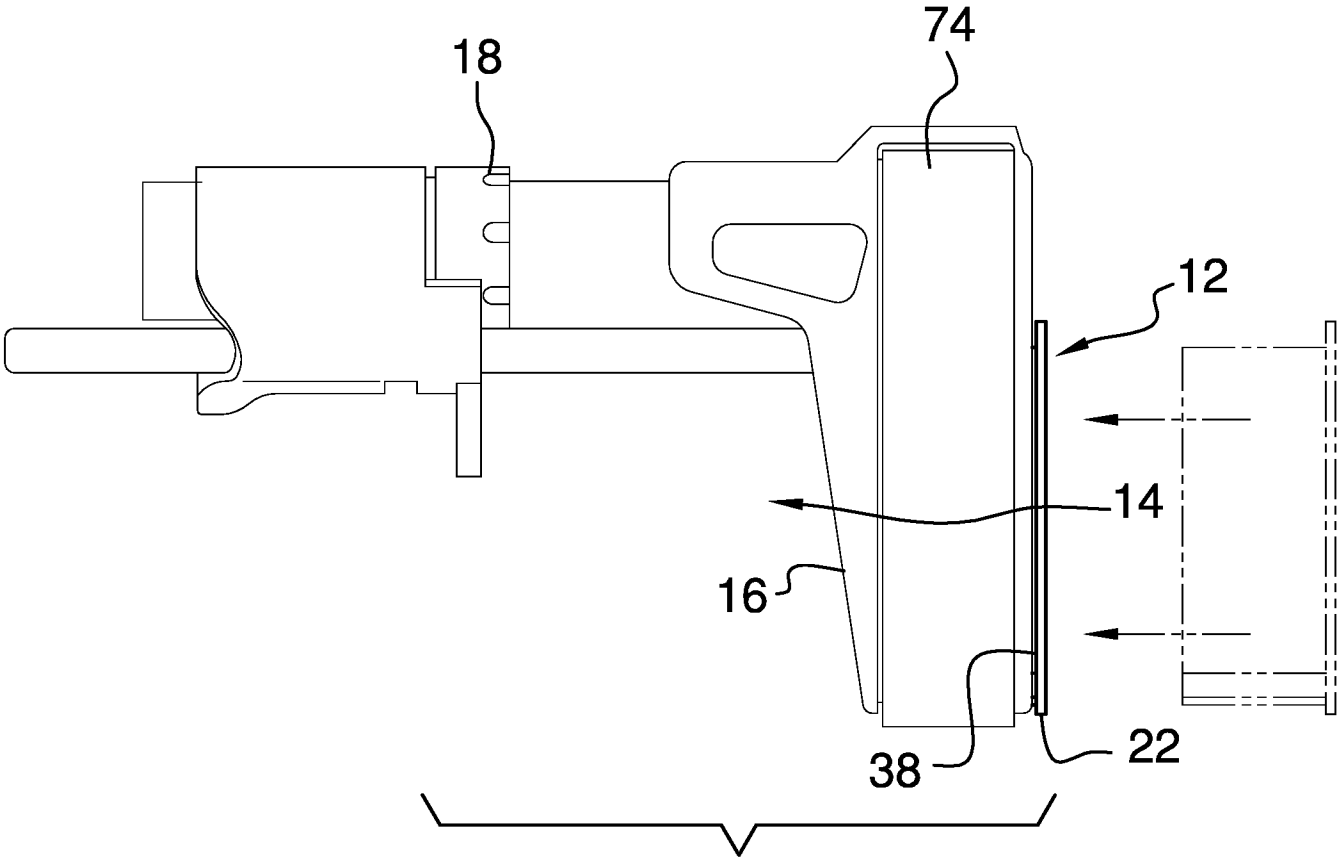
FIG. 5 is a perspective in-use view of an embodiment of the disclosure.

With reference now to the drawings, and in particular to FIGS. 1 through 5 thereof, a new plug device embodying the principles and concepts of an embodiment of the disclosure and generally designated by the reference numeral 10 will be described.

As best illustrated in FIGS. 1 through 5, the forearm brace plug assembly 10 generally comprises a plug 12 that is insertable into a forearm space 14 in a forearm brace 16 of a firearm 18 to inhibit the forearm brace 16 from being deformed during storage. The forearm brace 16 may be a forearm brace such as is manufactured by SB Tactical, 1225 Darlington Oak Circle NE, St. Petersburg, Fla., 33703. The plug 12 is comprised of a resiliently compressible material to conform to the shape of the forearm space 14. Additionally, the plug 12 has a storage chamber 20 therein to store objects.

The plug 12 comprises a base 22 that has a first surface 24, a second surface 26 and a perimeter edge 28 extending therebetween, and the perimeter edge 28 has a front side 30, a back side 32, a first lateral side 34 and a second lateral side 36. The perimeter edge 28 is rounded at each of four corners of the perimeter edge 28 and the base 22 is elongated between the front side 30 and the back side 32.

The plug 12 further comprises a block 38 that has a bottom surface 40, a top surface 42 and a perimeter surface 44 extending therebetween, and the perimeter surface 44 has a forward side 46, a rear side 48, a first sidelong side 50 and a second sidelong side 52. The block 38 is elongated between the forward side 46 and the rear side 48, the forward side 46 is concavely arcuate with respect to the rear side 48, and rear side 48 is concavely arcuate with respect to the forward side 46. Moreover, the forward side 46 has a point 54 disposed thereon and extending along an axis extending through the forward side 46 and the rear side 48 and the point 54 is centrally positioned on the forward side 46.

The bottom surface 40 is bonded to the first surface 24 of the base 22 and the block 38 is centrally positioned on the base 22 having the perimeter surface 44 being inset with respect to the perimeter edge 28 of the base 22. Additionally, the point 54 is directed toward the front side 30 of the perimeter edge 28 of the base 22. The block 38 is positioned in the forearm space 14 in the forearm brace 16 when the plug 12 is inserted into the forearm brace 16. In this way the block 38 retains the forearm brace 16 in its intended shape while the forearm brace 16 is being stored.

The storage chamber 20 extends through the top surface 42 of the block 38 toward the bottom surface 40 of the block 38. The storage chamber 20 has a bounding surface 56, and the bounding surface 56 has a forward side 58 and a rearward side 60. The top surface 42 has a well 62 extending toward the bottom surface 40 and the well 62 is positioned adjacent to the forward side 58 of the bounding surface 56 of the storage chamber 20. Additionally, the top surface 42 has a slot 64 extending toward the bottom surface 40 and the slot 64 is positioned adjacent to the rearward side 60 of the bounding surface 56 of the storage chamber 20.

A door 66 is provided and the door 66 is removably attachable to the plug 12. The door 66 is positioned over the storage chamber 20 to retain the objects within the storage chamber 20. The door 66 has a rear edge 68 and a front edge 70, and the door 66 has a tab 72 extending away from the rear edge 68. The tab 72 engages the slot 64 in the top surface 42 of the block 38 when the door 66 is positioned over the storage chamber 20. Additionally, the front edge 70 is exposed in the well 62 in the top surface 42 of the block 38 when the door 66 is positioned over the storage chamber 20. In this way the well 62 facilitates a user to grab the front edge 70 to remove the door 66 from the block 38. As is most clearly shown in FIG. 5, the forearm brace 16 may include a strap 74 that is wrappable around the forearm brace 16. The strap 74 may extend beneath the plug 12 when the plug 12 is inserted into the forearm brace 16.

In use, the door 66 is removed from the block 38 and the objects, such as small tools or other objects commonly employed in conjunction with the firearm 18, are positioned in the storage chamber 20. The plug 12 is inserted into the forearm space 14 when the forearm brace 16 is being stored. In this way the plug 12 inhibits the forearm brace 16 from becoming deformed during storage. The plug 12 is removed from the forearm space 14 prior to employing the forearm brace 16 for its intended purpose. Additionally, the objects stored within the storage chamber 20 can be retrieved from the plug 12 at any time.

With respect to the above description then, it is to be realized that the optimum dimensional relationships for the parts of an embodiment enabled by the disclosure, to include variations in size, materials, shape, form, function and manner of operation, assembly and use, are deemed readily apparent and obvious to one skilled in the art, and all equivalent relationships to those illustrated in the drawings and described in the specification are intended to be encompassed by an embodiment of the disclosure.

Therefore, the foregoing is considered as illustrative only of the principles of the disclosure. Further, since numerous modifications and changes will readily occur to those skilled in the art, it is not desired to limit the disclosure to the exact construction and operation shown and described, and accordingly, all suitable modifications and equivalents may be resorted to, falling within the scope of the disclosure. In this patent document, the word "comprising" is used in its non-limiting sense to mean that items following the word are included, but items not specifically mentioned are not excluded. A reference to an element by the indefinite article "a" does not exclude the possibility that more than one of the element is present, unless the context clearly requires that there be only one of the elements.

I claim:

1. A forearm brace plug assembly being configured to be positioned in a forearm brace for a firearm to inhibit the forearm brace from being deformed during storage, said assembly comprising:

a plug being insertable into a forearm space in a forearm brace of a firearm wherein said plug is configured to inhibit the forearm brace from being deformed during storage, said plug being comprised of a resiliently compressible material wherein said plug is configured to conform to the shape of the forearm space, said plug having a storage chamber therein wherein said storage chamber is configured to store objects;

a door being removably attachable to said plug, said door being positioned over said storage chamber wherein said door is configured to retain the objects within said storage chamber; and wherein said plug comprises a base having a first surface, a second surface and a perimeter edge extending therebetween, said perimeter edge having a front side, a back side, a first lateral side and a second lateral side, said perimeter edge being rounded at each of four corners of said perimeter edge, said base being elongated between said front side and said back side.

2. The assembly according to claim 1, wherein said plug includes a block having a bottom surface, a top surface and a perimeter surface extending therebetween, said perimeter surface having a forward side, a rear side, a first sidelong side and a second sidelong side, said block being elongated between said forward side and said rear side, said forward side being concavely arcuate with respect to said rear side, rear side being concavely arcuate with respect to said forward side.

3. The assembly according to claim 2, wherein said forward side has a point being disposed thereon and extending along an axis extending through said forward side and said rear side, said point being centrally positioned on said forward side.

4. The assembly according to claim 2, wherein said bottom surface is bonded to said first surface of said base, said block being centrally positioned on said base having said perimeter surface being inset with respect to said perimeter edge of said base, said point being directed toward said front side of said perimeter edge of said base, said block being positioned in the forearm space in the forearm brace when said plug is inserted into the forearm brace.

5. The assembly according to claim 2, wherein said storage chamber extends through said top surface of said block toward said bottom surface of said block, said storage chamber having a bounding surface, said bounding surface having a forward side and a rearward side.

6. The assembly according to claim 5, wherein said top surface has a well extending toward said bottom surface, said well being positioned adjacent to said forward side of said bounding surface of said storage chamber.

7. The assembly according to claim 5, wherein said top surface has a slot extending toward said bottom surface, said slot being positioned adjacent to said rearward side of said bounding surface of said storage chamber.

8. The assembly according to claim 2, wherein said door has a rear edge and a front edge, said door having a tab extending away from said rear edge, said tab engaging a slot in said top surface of said block when said door is positioned over said storage chamber.

9. The assembly according to claim 8, wherein said front edge is exposed in a well in said top surface of said block when said door is positioned over said storage chamber wherein said well is configured to facilitate a user to grab said front edge to remove said door from said block.

10. A forearm brace plug assembly being configured to be positioned in a forearm brace for a firearm to inhibit the forearm brace from being deformed during storage, said assembly comprising:

a plug being insertable into a forearm space in a forearm brace of a firearm wherein said plug is configured to inhibit the forearm brace from being deformed during storage, said plug being comprised of a resiliently compressible material wherein said plug is configured to conform to the shape of the forearm space, said plug having a storage chamber therein wherein said storage chamber is configured to store objects, said plug comprising:

a base having a first surface, a second surface and a perimeter edge extending therebetween, said perimeter edge having a front side, a back side, a first lateral side and a second lateral side, said perimeter edge being rounded at each of four corners of said perimeter edge, said base being elongated between said front side and said back side; and a block having a bottom surface, a top surface and a perimeter surface extending therebetween, said perimeter surface having a forward side, a rear side, a first sidelong side and a second sidelong side, said block being elongated between said forward side and said rear side, said forward side being concavely arcuate with respect to said rear side, rear side being concavely arcuate with respect to said forward side, said forward side having a point being disposed thereon and extending along an axis extending through said forward side and said rear side, said point being centrally positioned on said forward side, said bottom surface being bonded to said first surface of said base, said block being centrally positioned on said base having said perimeter surface being inset with respect to said perimeter edge of said base, said point being directed toward said front side of said perimeter edge of said base, said block being positioned in the forearm space in the forearm brace when said plug is inserted into the forearm brace, said storage chamber extending through said top surface of said block toward said bottom surface of said block, said storage chamber having a bounding surface, said bounding surface having a forward side and a rearward side, said top surface having a well extending toward said bottom surface, said well being positioned adjacent to said forward side of said bounding surface of said storage chamber, said top surface having a slot extending toward said bottom surface, said slot being positioned adjacent to said rearward side of said bounding surface of said storage chamber; and a door being removably attachable to said plug, said door being positioned over said storage chamber wherein said door is configured to retain the objects within said storage chamber, said door having a rear edge and a front edge, said door having a tab extending away from said rear edge, said tab engaging said slot in said top surface of said block when said door is positioned over said storage chamber, said front edge being exposed in said well in said top surface of said block when said door is positioned over said storage chamber wherein said well is configured to facilitate a user to grab said front edge to remove said door from said block.

11. A forearm brace plug system for positioning in a forearm brace for a firearm to inhibit the forearm brace from being deformed during storage, said assembly comprising:

a forearm brace for a firearm having a forearm space therein wherein said forearm space is configured to receive a user's forearm for stabilizing the firearm;

a plug being insertable into said forearm space in said forearm brace to inhibit said forearm brace from being deformed during storage, said plug being comprised of a resiliently compressible material conform to the shape of said forearm space, said plug having a storage chamber therein wherein said storage chamber is configured to store objects, said plug comprising:

a base having a first surface, a second surface and a perimeter edge extending therebetween, said perimeter edge having a front side, a back side, a first lateral side and a second lateral side, said perimeter edge being rounded at each of four corners of said perimeter edge, said base being elongated between said front side and said back side; and a block having a bottom surface, a top surface and a perimeter surface extending therebetween, said perimeter surface having a forward side, a rear side, a first sidelong side and a second sidelong side, said block being elongated between said forward side and said rear side, said forward side being concavely arcuate with respect to said rear side, rear side being concavely arcuate with respect to said forward side, said forward side having a point being disposed thereon and extending along an axis extending through said forward side and said rear side, said point being centrally positioned on said forward side, said bottom surface being bonded to said first surface of said base, said block being centrally positioned on said base having said perimeter surface being inset with respect to said perimeter edge of said base, said point being directed toward said front side of said perimeter edge of said base, said block being positioned in said forearm space in said forearm brace when said plug is inserted into the forearm brace, said storage chamber extending through said top surface of said block toward said bottom surface of said block, said storage chamber having a bounding surface, said bounding surface having a forward side and a rearward side, said top surface having a well extending toward said bottom surface, said well being positioned adjacent to said forward side of said bounding surface of said storage chamber, said top surface having a slot extending toward said bottom surface, said slot being positioned adjacent to said rearward side of said bounding surface of said storage chamber; and a door being removably attachable to said plug, said door being positioned over said storage chamber wherein said door is configured to retain the objects within said storage chamber, said door having a rear edge and a front edge, said door having a tab extending away from said rear edge, said tab engaging said slot in said top surface of said block when said door is positioned over said storage chamber, said front edge being exposed in said well in said top surface of said block when said door is positioned over said storage chamber wherein said well is configured to facilitate a user to grab said front edge to remove said door from said block.

* * * * *